US008025348B2

(12) United States Patent
Gasser

(10) Patent No.: US 8,025,348 B2
(45) Date of Patent: Sep. 27, 2011

(54) SUPPORT ELEMENT FOR SECURING IN A FURNITURE CARCASS

(75) Inventor: Ingo Gasser, Höchst (AT)

(73) Assignee: Julius Blum GmbH, Hochst (AT)

( * ) Notice: Subject to any disclaimer, the term of this patent is extended or adjusted under 35 U.S.C. 154(b) by 288 days.

(21) Appl. No.: 11/706,274

(22) Filed: Feb. 15, 2007

(65) Prior Publication Data

US 2007/0145867 A1 Jun. 28, 2007

Related U.S. Application Data

(63) Continuation of application No. PCT/AT2005/000247, filed on Jul. 1, 2005.

(30) Foreign Application Priority Data

Aug. 16, 2004 (AT) ..... A 1380/2004

(51) Int. Cl.
*A47B 95/02* (2006.01)

(52) U.S. Cl. ..... 312/319.5; 312/330.1

(58) Field of Classification Search ..... 312/140, 312/114, 223.6, 333, 334.6, 334.7, 334.12, 312/334.18, 334.25, 334.26, 334.33, 33, 312/4.36, 334.37, 334.38, 334.39, 334.41, 312/334.43, 330.1, 319.1, 319.5–319.8; 108/23; 362/127, 133, 253, 234
See application file for complete search history.

(56) References Cited

U.S. PATENT DOCUMENTS

| | | | | |
|---|---|---|---|---|
| 2,187,012 | A | 1/1940 | Brenner | |
| 3,259,443 | A * | 7/1966 | Lavigne et al. | 312/126 |
| 3,592,521 | A * | 7/1971 | Cox | 312/333 |
| 4,689,726 | A * | 8/1987 | Kretzschmar | 362/127 |
| 4,792,195 | A | 12/1988 | Adriaansen et al. | |
| 5,470,143 | A | 11/1995 | Gill | |
| 5,542,759 | A * | 8/1996 | Krivec | 312/334.44 |
| 6,231,205 | B1 | 5/2001 | Slesinger et al. | |
| 6,288,333 | B1 * | 9/2001 | Liu et al. | 174/563 |
| 6,312,186 | B1 | 11/2001 | Röck et al. | |
| 6,669,250 | B1 * | 12/2003 | St. Louis | 292/341.11 |
| 2004/0100169 | A1 * | 5/2004 | Huber et al. | 312/319.5 |
| 2006/0061245 | A1 * | 3/2006 | Huber et al. | 312/348.1 |
| 2009/0039745 | A1 * | 2/2009 | Wong | 312/333 |

FOREIGN PATENT DOCUMENTS

| | | |
|---|---|---|
| CN | 2 444 381 | 8/2001 |
| CN | 2609163 | 3/2004 |
| DE | 1 778 452 | 10/1971 |
| DE | 93 12 842.8 | 2/1994 |
| DE | 198 06 337 | 8/1999 |
| DE | 201 03 713 | 6/2001 |
| EP | 1 391 166 | 2/2004 |
| EP | 1 479 319 | 11/2004 |
| JP | 56-7406 | 2/1981 |

OTHER PUBLICATIONS

Japanese Office Action (Notification of Reasons of Refusal) issued May 10, 2011 in corresponding Japanese Patent Application No. 2007-526103.

* cited by examiner

*Primary Examiner* — James O Hansen
*Assistant Examiner* — Matthew Ing
(74) *Attorney, Agent, or Firm* — Wenderoth, Lind & Ponack, L.L.P.

(57) ABSTRACT

A support element to be secured in a furniture carcass. One or more components, preferably push-out devices for pushing out a movable furniture part mounted in the furniture carcass, are securable to the support element without a tool, preferably in a manner such that they may be snap-fitted on.

13 Claims, 10 Drawing Sheets

SUPPORT ELEMENT FOR SECURING IN A FURNITURE CARCASS

The present invention is a continuation of International Application PCT/AT2005/000247, filed Jul. 1, 2005.

BACKGROUND OF THE INVENTION

The present invention relates to a support element for securing in a furniture carcass.

Modern furniture is frequently equipped with, in particular, electrical components, for example push-out devices for pushing out movable furniture parts. Hitherto, components of this kind had to be secured individually to the furniture carcass, in a fiddly procedure. In the case of electrical components, provision also had to be made hitherto for the supply of power individually to each component. This increases the manufacturing costs for a piece of furniture of this kind, because of the high level of complexity of the work.

SUMMARY OF THE INVENTION

The object of the invention is to provide a support element which allows furniture to be equipped with various components in a simple and inexpensive manner.

In accordance with the invention, this is achieved in that one or more push-out devices for pushing out a movable furniture part mounted in the furniture carcass, are securable to the support element without tools, preferably in a manner such that they may be snap-fitted on.

The possibility of securing the various push-out devices without tools reduces the manufacturing costs of a piece of furniture equipped with the support element according to the invention and enables push-out devices to be replaced later, or added, in a simple manner.

The possibility of securing without tools may, for example, take the form of a snap-fit connection.

To make the snap-fit connection, at least one, preferably two, groove(s) may be made in the support element. The grooves receive the corresponding number of springs arranged on the push-out. As an alternative, the groove(s) could be made on the push-out devices to be mounted and the spring(s) could be arranged on the support element.

Particularly preferably, the support element may have at least two power lines for supplying the push-out devices in the secured condition thereof. This enables the secured push-out devices to be supplied with power in a simple manner.

The support element according to the invention may, for example, take the form of a rail, preferably the form of a profiled rail.

When the support element is in the form of a rail, a particular possibility is for the power lines to be in the form of busbars running over substantially the entire length of the support element. Contact may be made with these busbars through contacts (for example supporting contacts) arranged on the components in the secured condition.

Frequently, the push-out devices are provided with various sensors for capturing data. This data may be processed in the push-out devices themselves and/or passed on to other push-out devices such as a control or regulating device. In this case, it may be provided for the support element to have at least one data bus for the purpose of information exchange with or between the devices. This makes it possible for data to be exchanged between a central control or regulating device and the individual push-out devices, and for data to be exchanged between the individual push-out devices.

To provide a suitable operating voltage for the push-out devices, it may be provided for a—and preferably specifically one—component in the form of a transformer for supplying the other components to be secured to the support element without tools, preferably in such a manner that it is snap-fitted on. If specifically one transformer is provided for supplying all the components secured to the support element, then either each component may be connected individually to the transformer or the transformer and the individual components may be connected in series. For example, the transformer may provide voltage to busbars arranged on the support element, and each component may make contact with the busbar.

A further variant on the invention relates to a support element for securing to a furniture carcass.

Hitherto, the problem arose that the position of push-out devices to be mounted in the furniture carcass had to be measured out individually. This is extremely fiddly, in particular when a plurality of push-out devices are mounted.

The variant on the invention solves this problem in that the support element has at least one predetermined securing position for components which are to be secured to the support element.

This means that there is no need to measure out the securing positions individually and painstakingly.

In a particularly preferred embodiment of this variant on the invention, the support element may be in the form of a rail and the support element may have at least two predetermined securing positions along its longitudinal extent.

It is particularly simple to mount push-out devices if it is provided for the push-out devices which are to be secured to be securable in the predetermined securing positions without tools, preferably in such a manner that they may be snap-fitted on.

The invention furthermore relates to a support element on which at least two push-out devices for movable furniture parts are arranged. Pre-equipped support elements of this kind may be secured in the piece of furniture as a unit, in a simple manner. This therefore makes it possible to prefabricate fully equipped support elements which are ready for use.

The invention furthermore relates to a furniture carcass on which at least one support element of the above-mentioned type is arranged.

To further reduce the manufacturing costs, it may be particularly advantageous for at least two support elements to be arranged in or on the furniture carcass and for the at least two support elements to be in electrically conductive connection with one another by way of a coupling part. This may serve both to supply power to the components on the individual support elements and to exchange data between them. This minimizes the number of voltage sources or transformers needed to supply power to the components.

In this connection, to further reduce the voltage sources or transformers needed, it may be provided for a—and preferably specifically one—transformer, for supplying all the components which are secured or securable to the support elements, to be secured to one of the support elements without tools, preferably in such a manner that it is snap-fitted on.

If one or more support rails is or are provided with predetermined securing positions, it is particularly advantageous if the predetermined securing positions form a vertical pattern and/or a lateral pattern in the furniture carcass for the components which are to be secured.

The invention furthermore relates to an arrangement having at least two furniture carcasses of the above-mentioned type.

In this connection, it may be particularly preferably provided for a transformer to be secured, in at least a first furniture carcass, to a support element without tools, preferably in such a manner that it is snap-fitted on, and for the transformer to be in electrically conductive connection with a support element, arranged in a second furniture carcass, for supplying the components which are secured or securable to this support element. In this embodiment of the invention, it is not therefore necessary to provide a separate transformer in each furniture carcass.

For the purpose of control or regulation of the components, it may be provided for the arrangement to include at least one control or regulating device.

If the support elements are in electrically conductive connection in the individual furniture carcasses, this may be utilized both for power supply and for data exchange. In this connection, specifically one control or regulating device may be provided for the purpose of controlling or regulating all the components arranged in the furniture carcasses of the arrangement.

BRIEF DESCRIPTION OF THE DRAWINGS

Further advantages and details of the invention will emerge from the description of the figures which follows, in which.

DETAILED DESCRIPTION OF THE INVENTION

Figure 1B:
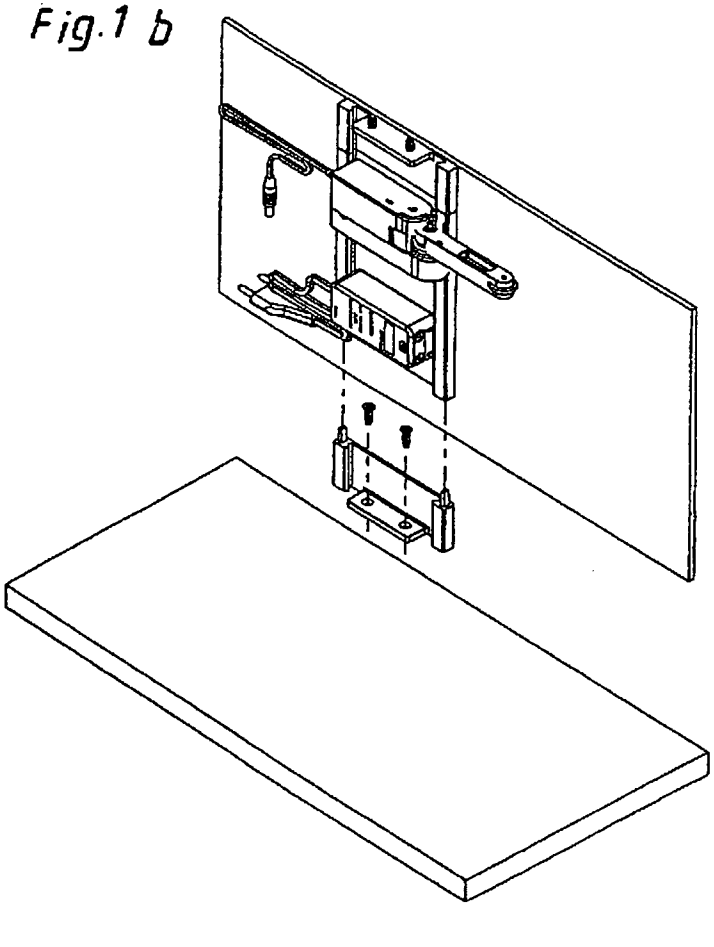
FIGS. 1*a* and 1*b* are diagrammatic perspective views of a first embodiment of the invention.
Figure 1A:
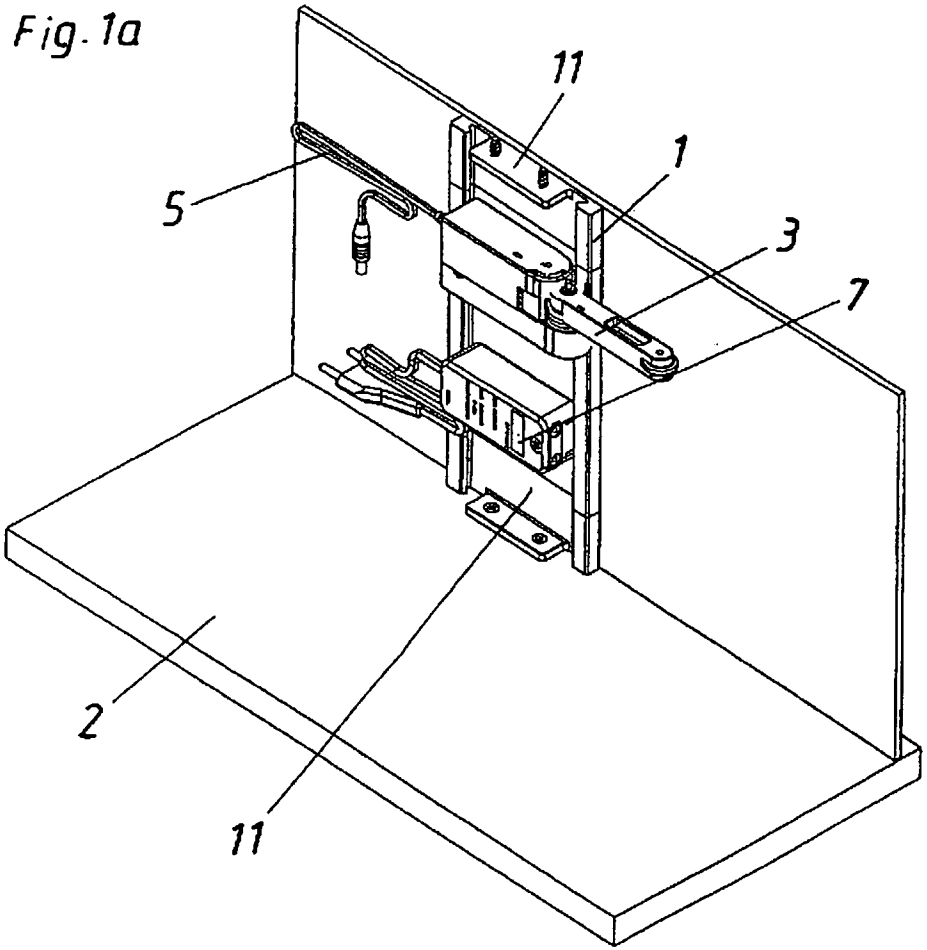

FIG. 1*a* shows a detail of a furniture carcass 2, to the upper and lower sides of which an embodiment of a support element 1 according to the invention is secured by way of the terminating parts 11. As a result of securing the support element 1 to the upper and lower sides, it is also possible to install it in a furniture carcass 2 with no rear wall (not illustrated). A push-out device 3 for a movable furniture part 4 (not illustrated in FIG. 1) and a transformer 7 for supplying the push-out device 3 are snap-fitted to the support element 1. The push-out device 3 has a power line 5 arranged to make contact with the transformer 7. FIG. 1*b* shows diagrammatically how the support element 1 is secured to the furniture carcass 2.

Figure 2B:
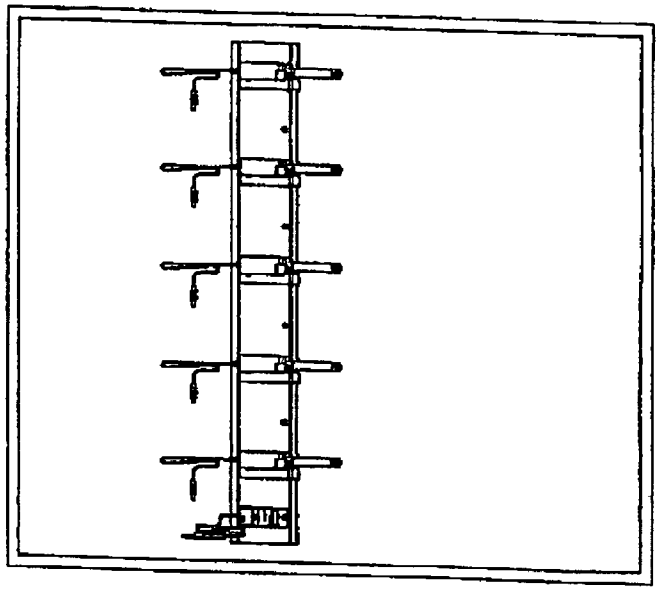
FIGS. 2*a* and 2*b* are a diagrammatic perspective view and a front view, respectively, of a further embodiment of the invention.
Figure 2A:
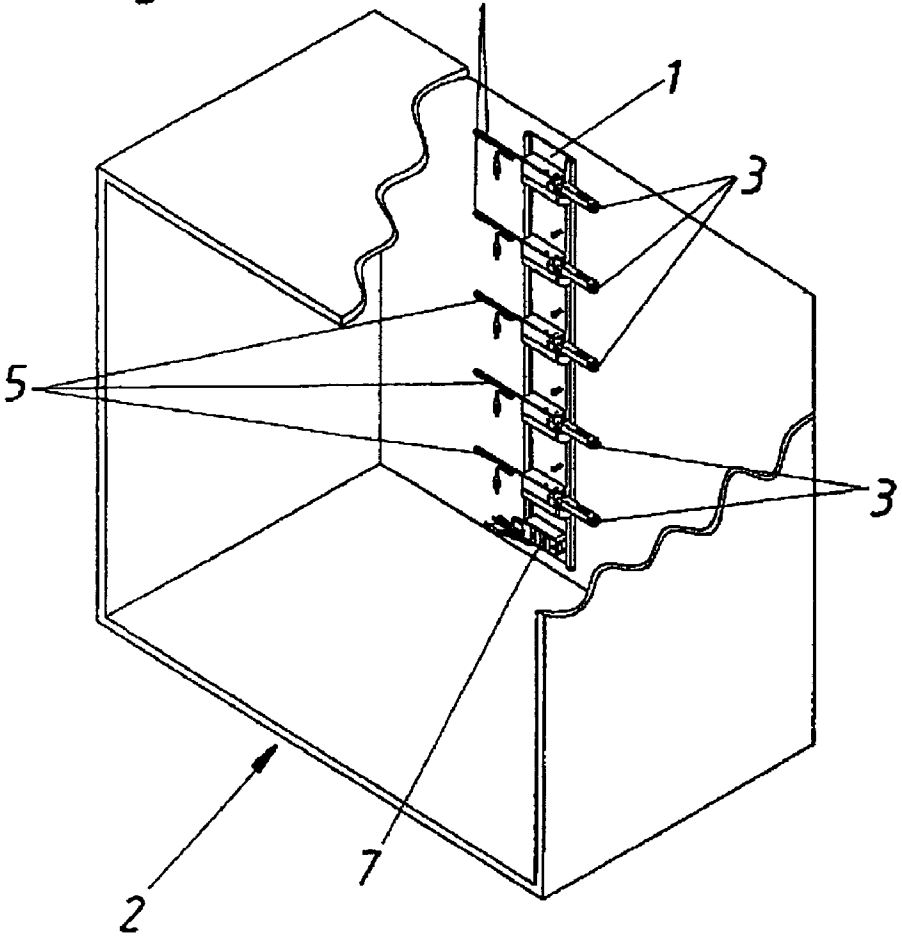

FIG. 2*a* shows a piece of furniture on the furniture carcass 2, on which there is arranged a support element 1 in the form of a profiled rail (track), with a plurality of push-out devices 3 secured to the support element 1. The push-out devices 3 (of which there are five in this embodiment) are supplied with power by the single transformer 7. FIG. 2*b* shows a front view of the piece of furniture illustrated in FIG. 2*a*. The track of the support element 1 is also arranged to extend in the vertical direction.

Figure 3B:
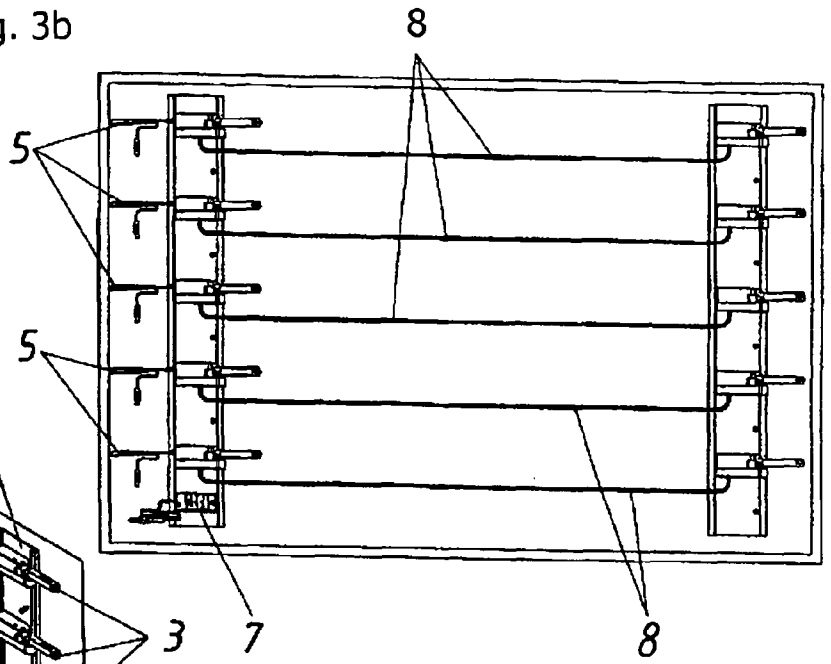
FIGS. 3*a* and 3*b* are a diagrammatic perspective view and a front view, respectively, of a further embodiment of the invention.
Figure 3A:
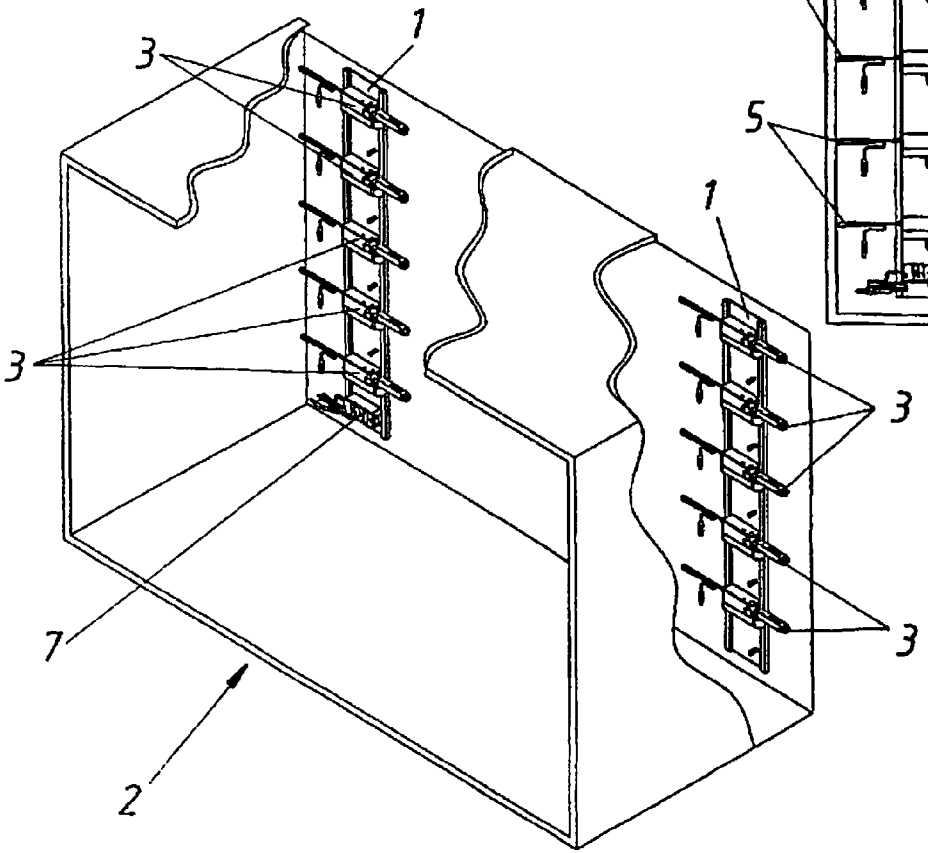

FIG. 3*a* shows a further piece of furniture, having a furniture carcass 2 on which two support elements 1 including a track and push-out device according to the invention are arranged, with five push-out devices 3 secured to each track 1. In this embodiment, only a single transformer 7 is provided for supplying all the push-out devices 3. It is clear from FIG. 3*b*, which is a front view of the piece of furniture shown in FIG. 3*a*, that the push-out devices 3 arranged on the right-hand side in FIG. 3*b* are connected to a respective push-out device 3 arranged on the left-hand side for the purpose of providing power by way of connections 8. Each push-out device 3 arranged on the left-hand side is in this case connectable to the transformer 7 by way of the power lines 5 illustrated.

Figure 4:
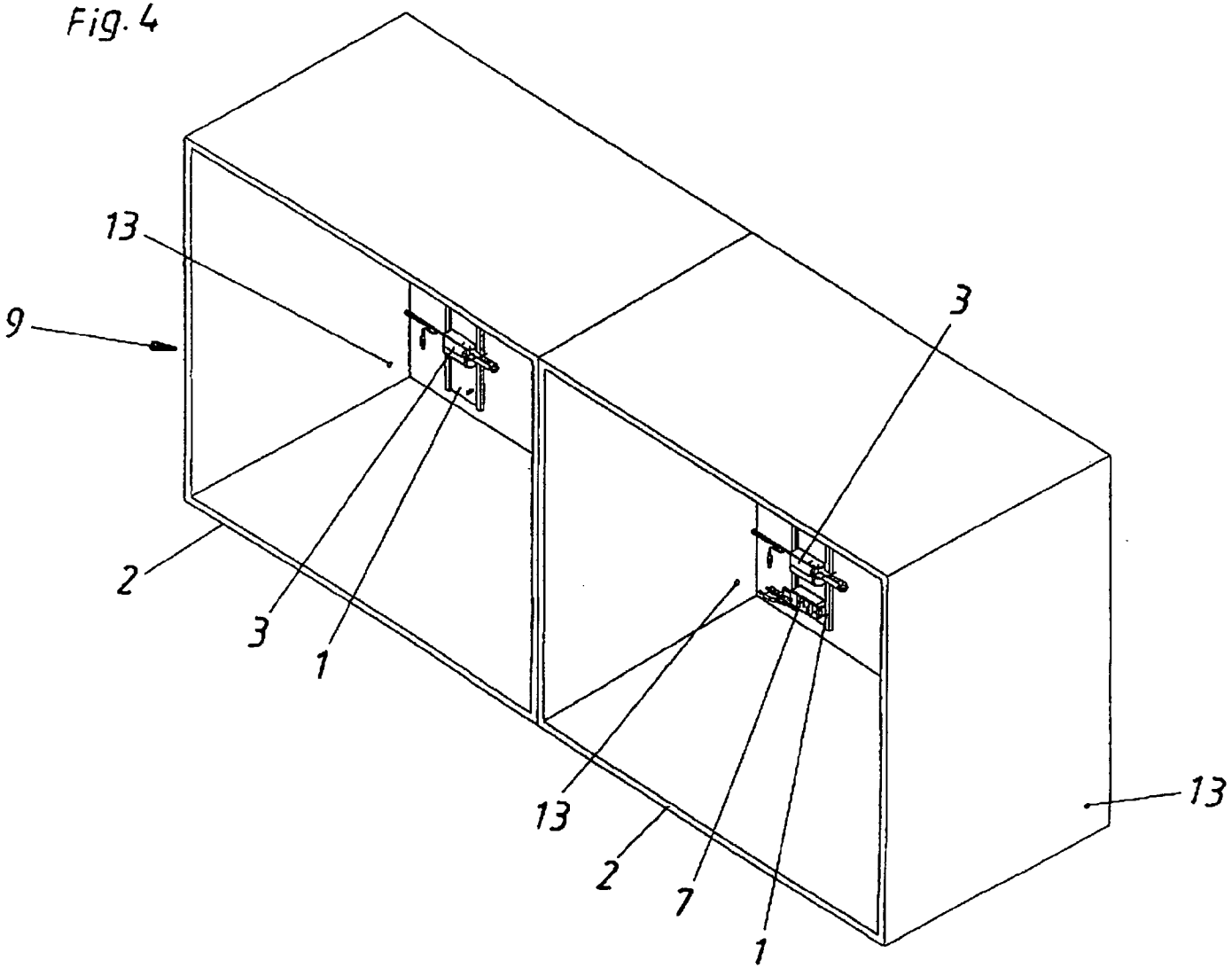
FIG. 4 is a diagrammatic perspective illustration of an embodiment of an arrangement according to the invention.

FIG. 4 shows a furniture arrangement 9 comprising two furniture carcasses 2, in each of which there is arranged a support element 1 according to the invention. Secured to each track of support element 1 is a plurality of push-out devices 3, only one push-out device 3 being visible in each case in FIG. 4. Provided on the support element 1 on the right-hand side in FIG. 4 is a single transformer 7 for supplying the push-out devices 3 on this support element 1 and for supplying the push-out devices 3 on the support element 1 arranged in the left-hand furniture carcass 2. The current-carrying connection can in this case be guided through the openings 13 between the furniture carcasses 2.

Figure 5A:
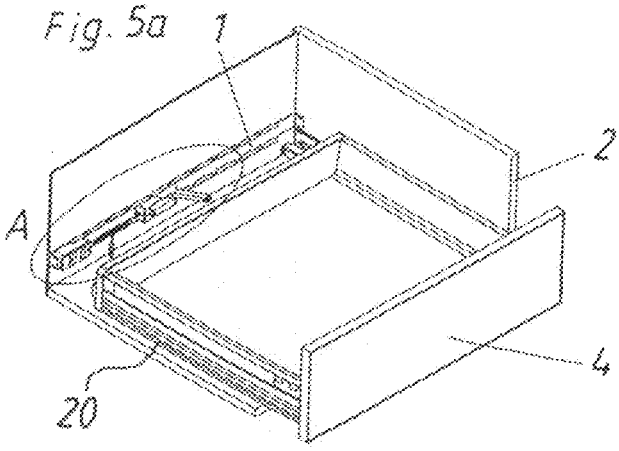
FIGS. 5*a* and 5*b* are illustrations of a further example embodiment of the invention in a diagrammatic perspective view and a detail view.
Figure 5B:
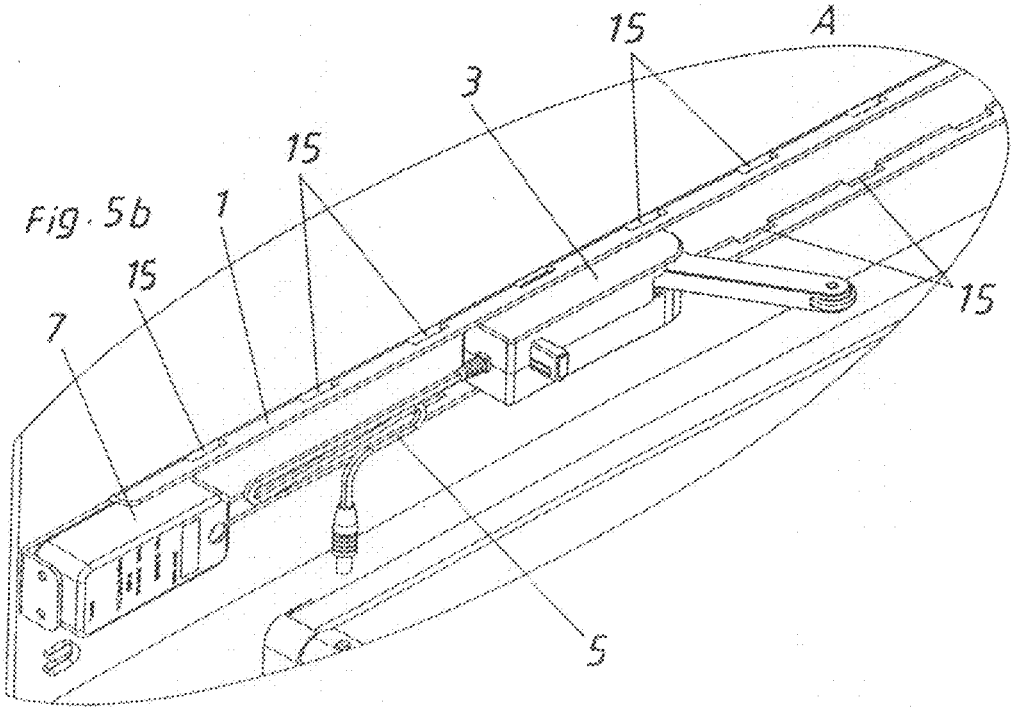

FIG. 5*a* shows a further embodiment of a support element 1 according to the invention, in which the support element 1 is arranged horizontally in the furniture carcass 2. It is clear from the detail view illustrated in FIG. 5*b* that a push-out device 3 for the movable furniture part 4 and a transformer 7 for supplying power to the push-out device 3 are arranged on the track of support element 1. Meanwhile, as is clear from FIG. 5A, the support element 1 does not support the movable furniture part 4. More particularly, as is clear from at least FIGS. 5*a* and 5*b*, the track of support element 1 is mounted to furniture carcass 2 such that it is not supported by the support for supporting the movable furniture part 4, and such that the rail of support element 1 can be positioned without regard to a position of the guide rail 20 for supporting the movable furniture part 4. In this case, the push-out device 3 and the transformer 7 can be connected by way of the power line 5. Also visible are the predetermined securing positions 15 for the components to be secured, which in this embodiment take the form of recesses into which anchoring lugs arranged on the components may be inserted. As a result of the horizontal alignment of the track of support element 1 in the furniture carcass 2, a lateral pattern, that is a horizontal one, for the components to be secured is formed.

Figures 6A, 6B, 6C:
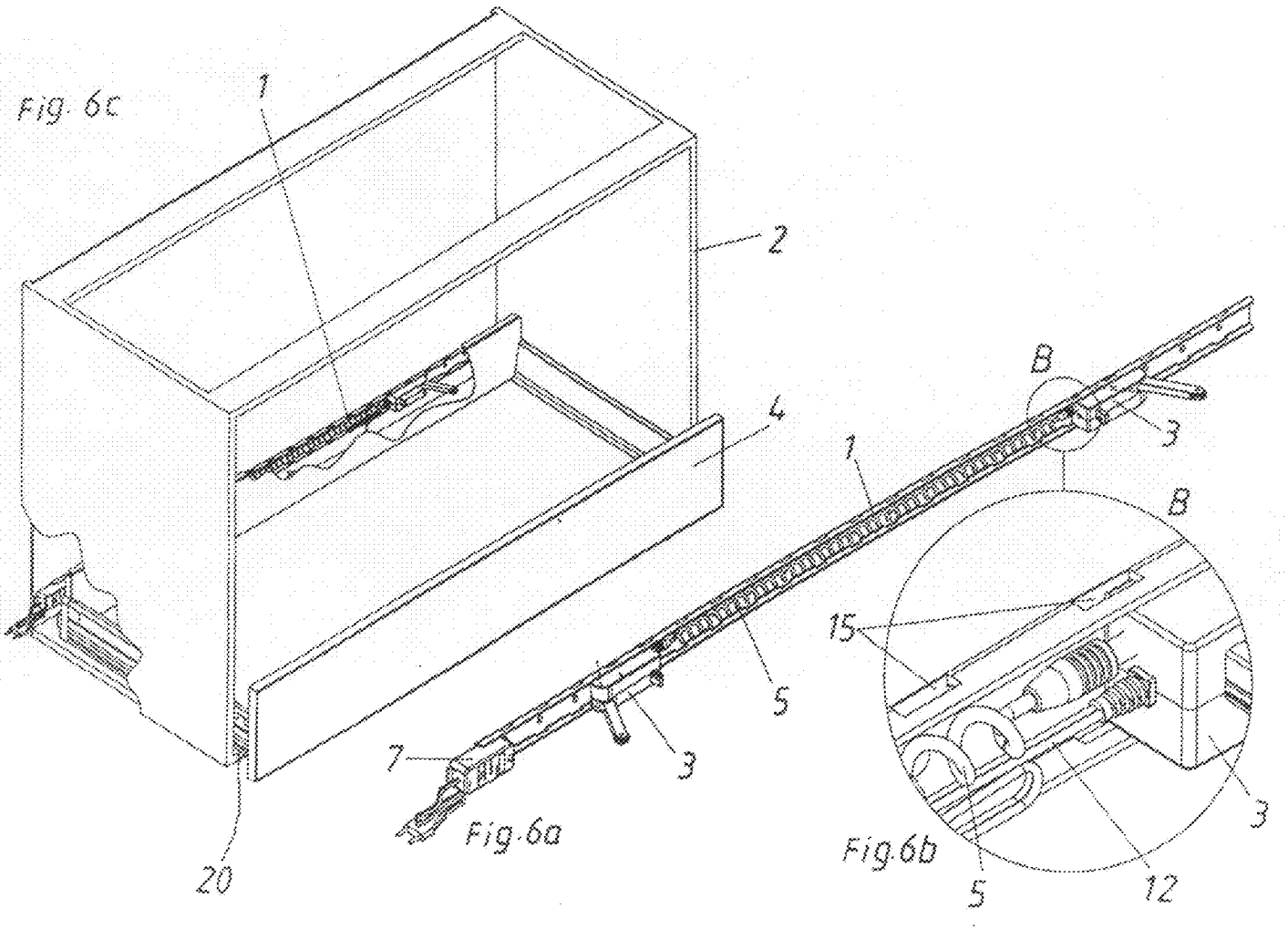
FIGS. 6*a*, 6*b* and 6*c* are illustrations of a further embodiment of the invention in a diagrammatic perspective view, a detail view and in the condition installed in a furniture carcass.

FIG. 6*a* shows, in a manner similar to FIG. 5, a further embodiment of a support element 1 according to the invention, on which two push-out devices 3 and a single transformer 7 are arranged on the track. In FIG. 6*a*, the two push-out devices 3 are connected to one another by way of a power line 5. Here, the push-out device 3 which is arranged closer to the transformer 7 may be connected by way of a connection (not illustrated) for the purpose of jointly connecting the two push-out devices 3 to the transformer 7.

FIG. 6*b* shows a detail view of the embodiment of FIG. 6*a*. In particular, in addition to the power line 5, a data cable 12 for connecting the push-out devices 3 is provided. This makes it possible to exchange data between the two push-out devices 3.

FIG. 6*c* shows a piece of furniture having a furniture carcass 2 and a movable furniture part 4, with the track of support element 1 illustrated in FIG. 6*a* arranged on the rear side of the furniture carcass 2 so as not to support the movable furniture part 4 (supported by guide rail 20).

Figure 7:
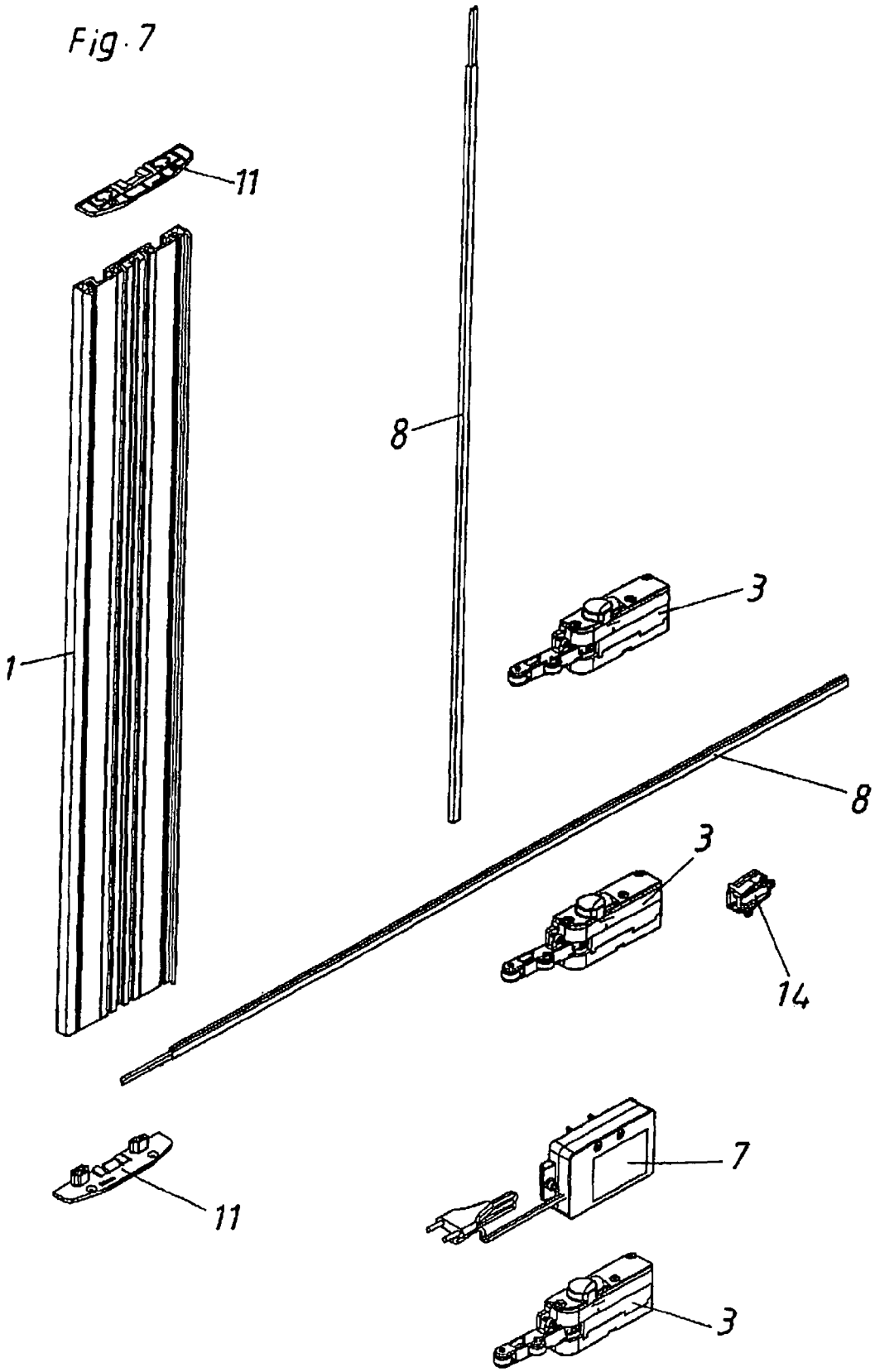
FIG. 7 is an illustration of a further example embodiment of the invention in a diagrammatic perspective illustration.
Figure 8E:
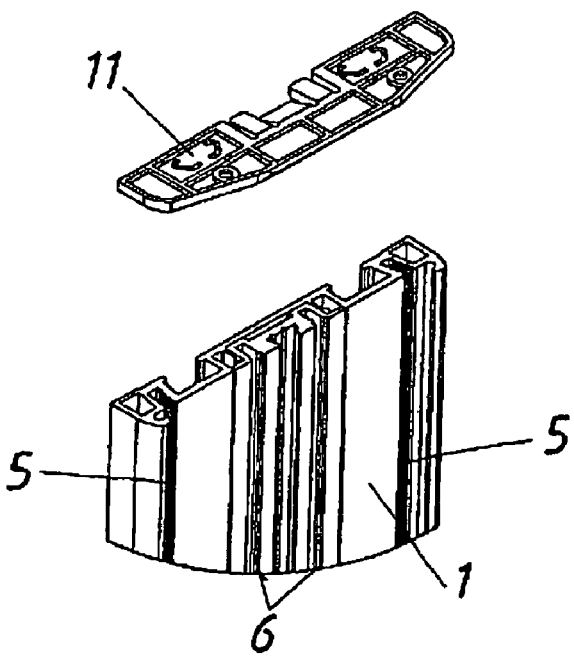
FIGS. 8*a* to 8*f* are views of individual components of an example embodiment of the invention.
Figure 8D:
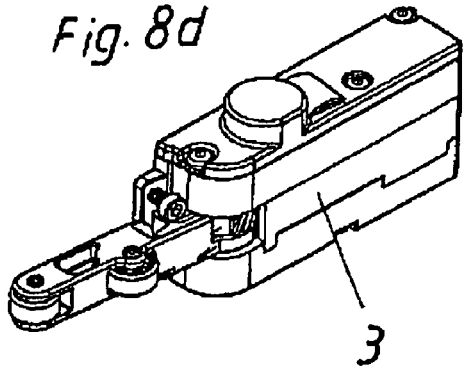
Figure 8F:
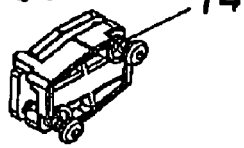
Figure 8B:
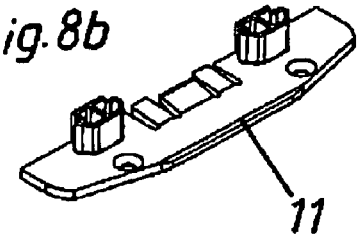
Figure 8C:
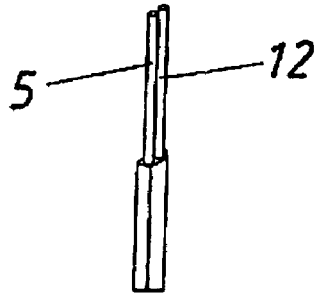
Figure 8A:
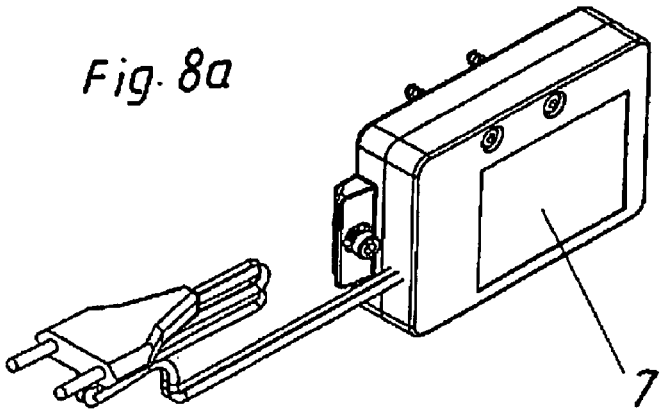

FIG. 7 shows, in an exploded illustration, a further embodiment of a support element 1 according to the invention, comprises a profiled track. In this case, along the entire length of the track of support element 1 there are provided both power lines 5, in the form of busbars, and data buses 6 (that is to say, conductive connections for data transport) as shown in FIG. 8*b*. Furthermore visible are push-out devices 3, a transformer 7 and terminating parts 11. The support element 1 can be coupled to further support elements 1 (not illustrated), by way of the connections 8 illustrated in FIG. 7 and the coupling part 14 (in this case a cross connecting element), in a manner illustrated in more detail in FIG. 9*a*. These further support elements 1 may in this case be arranged in the same piece of furniture or in other pieces of furniture.

FIGS. 8*a* to 8*f* show again, in detail, the components which have already been illustrated and described above.

Figures 9A, 9B:
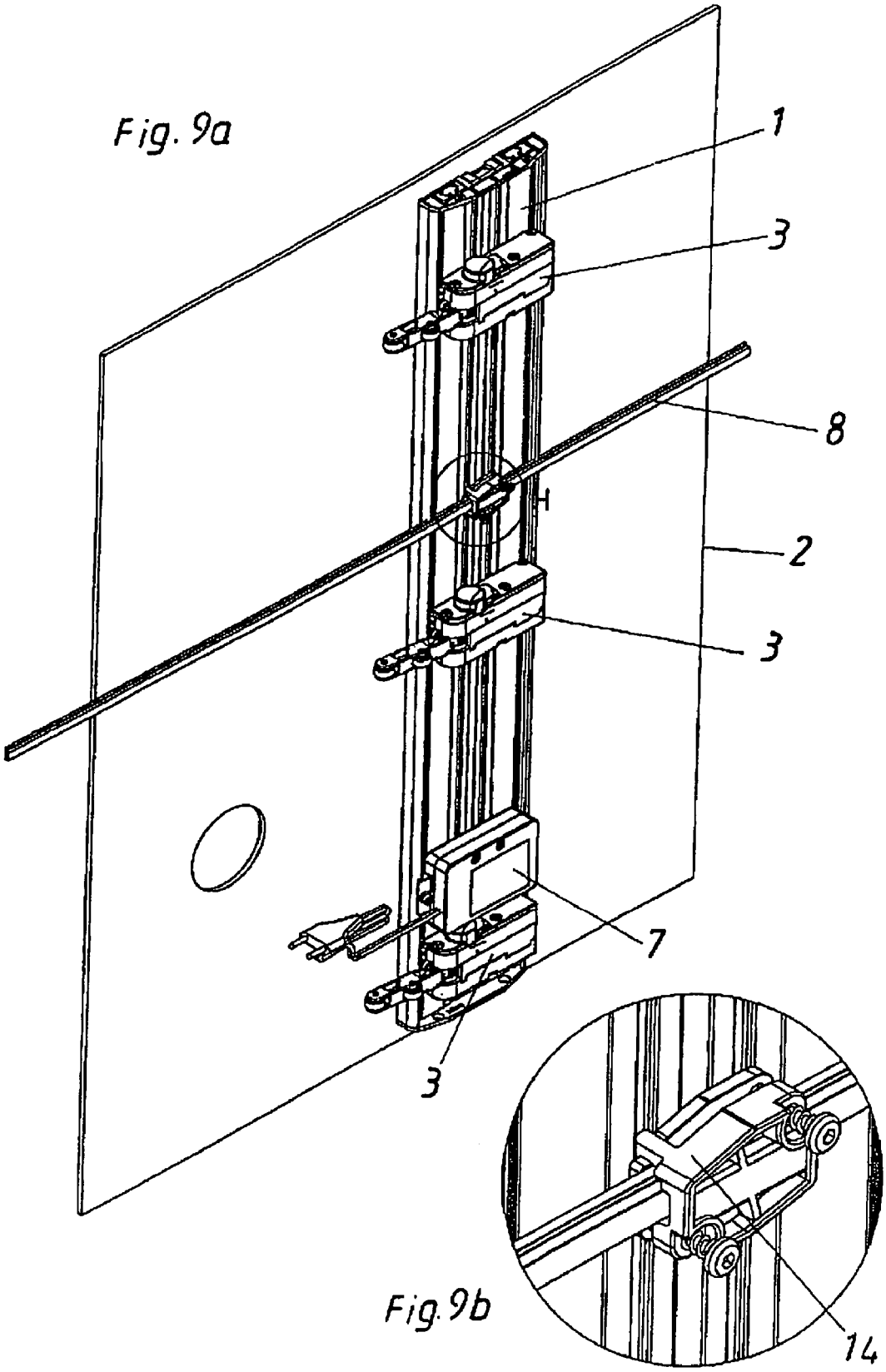
FIGS. 9*a* and 9*b* are views of a further embodiment of the invention in a diagrammatic perspective illustration and a detail illustration.

FIG. 9*a* shows the support element 1 illustrated in the exploded illustration of FIG. 7, in the assembled condition and secured to the furniture carcass 2. The detail illustration of FIG. 9*b* shows, in particular, the coupling part 14, which is, on the one hand, coupled to the busbars and the data bus 6 of the support element 1 and, on the other hand, connects them to the connections 8 leading to further support elements 1 (not illustrated).

Figure 10B:
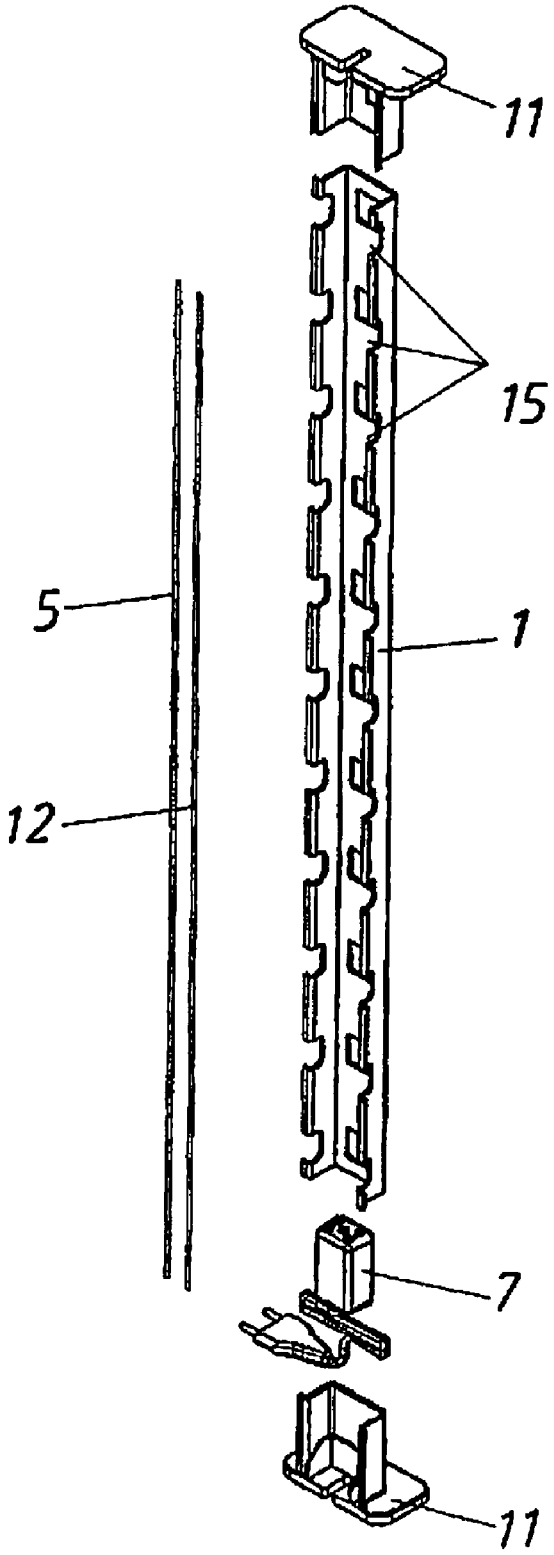
FIGS. 10*a* and 10*b* are views of a further example embodiment of the invention in a diagrammatic perspective illustration and in an exploded illustration.
Figure 10A:
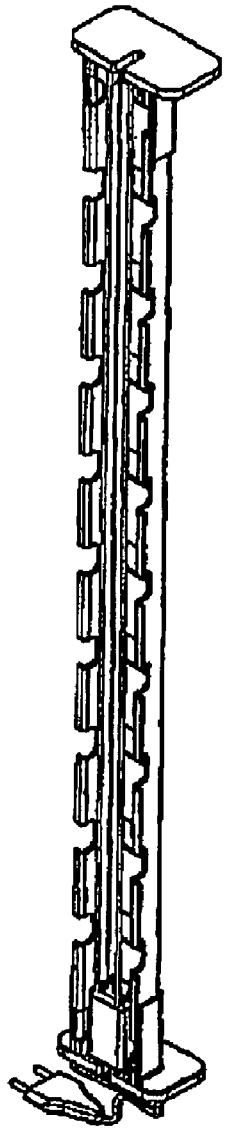

FIGS. 10*a* and 10*b* show a further embodiment of a support element 1 according to the invention, which has a power line 5 and a data line 12. Also visible are the predetermined securing positions 15, which in this embodiment form a vertical pattern, that is an upright one, for the components to be secured.

It goes without saying that, in the entire disclosure, the type of components is not restricted to push-out devices or transformers.

The invention claimed is:

1. A furniture component comprising:

a furniture carcass;

a movable furniture part operable to be moved relative to said furniture carcass;

a guide rail mounted to said furniture carcass, said guide rail being connected to said movable furniture part and supporting said movable furniture part such that said movable furniture part is operable to move relative to said furniture carcass; and a support element secured to said furniture carcass, said support element including:

a track mounted to said furniture carcass such that said track is supported by said furniture carcass, said track being arranged separate from and not supported by said guide rail, said guide rail being arranged separate from and not supported by said track, said support element being configured and arranged such that said track is mountable at a position on said furniture carcass without regard to a position of said guide rail on said furniture carcass; and at least one push-out device for pushing said movable furniture part so as to move said movable furniture part along said guide rail relative to said furniture carcass, each of said at least one push-out device being secured to said track; wherein said support element further includes at least two power lines for supplying power to said at least one push-out device; and wherein said track of said support element is arranged in a vertical direction and said guide rail is arranged in a horizontal direction, said track being configured to allow said at least one push-out device to be secured to said track at any location along the vertical direction.

2. The furniture component of claim 1, wherein said track of said support element comprises a profiled track.

3. The furniture component of claim 1, wherein said support element further includes busbars extending over substantially an entire length of said track.

4. The furniture component of claim 1, wherein said support element further includes at least one data bus for exchanging information between said at least one push-out device.

5. The furniture component of claim 1, wherein said support element further includes a transformer for supplying power to said at least one push-out device.

6. The furniture component of claim 5, wherein said support element includes exactly one transformer for supplying power to all of said at least one push-out device.

7. The furniture component of claim 1, wherein said support element comprises a first support element, further comprising a second support element secured to said furniture carcass such that said first support element and said second support element are electrically connected with each other by a coupling part.

8. The furniture component of claim 7, wherein said first support element further includes a transformer for supplying power to all components secured to said first support element and said second support element, said transformer being secured to said track of said first support element.

9. The furniture component of claim 1, wherein said track of said support element has predetermined securing positions arranged to form at least one of a vertical pattern and a lateral pattern on said furniture carcass.

10. The furniture component of claim 1, wherein said furniture carcass comprises a first furniture carcass, further comprising a second furniture carcass.

11. The furniture component of claim 10, wherein said support element comprises a first support element secured to said first furniture carcass, further comprising a second support element secured to said second furniture carcass, said first support element including a transformer secured to said track of said first support element such that said transformer is electrically connected to both said first support element and said second support element for supplying power to all components secured to said first support element and said second support element.

12. The furniture component of claim 1, further comprising a control device for controlling and regulating operation of said at least one push-out device of said support element.

13. The furniture component of claim 1, wherein said at least one push-out device is snap-fitted on said track of said support element.

* * * * *